United States Patent [19]

Schmidt

[11] 4,407,001

[45] Sep. 27, 1983

[54] FOCAL AXIS RESOLVER FOR OFFSET REFLECTOR ANTENNAS

[75] Inventor: Richard F. Schmidt, Seabrook, Md.

[73] Assignee: The United States of America as represented by the Administrator of the National Aeronautics and Space Administration, Washington, D.C.

[21] Appl. No.: 308,009

[22] Filed: Oct. 2, 1981

[51] Int. Cl.[3] ..... H01Q 19/02

[52] U.S. Cl. ..... 343/840; 343/100 AP

[58] Field of Search ..... 343/703, 840, 912, 100 AP

[56] References Cited

U.S. PATENT DOCUMENTS

| | | | |
|---|---|---|---|
| 3,696,435 | 10/1972 | Zucker | 343/779 |
| 3,792,480 | 2/1974 | Graham | 343/781 R |
| 3,914,768 | 10/1975 | Ohm | 343/779 |

*Primary Examiner*—Eli Lieberman

*Attorney, Agent, or Firm*—Robert E. Bushnell; John R. Manning; John O. Tresansky

[57] ABSTRACT

Method and apparatus for determining the focal axis (26) of an asymmetrical antenna (14) such as an offset paraboloid reflector whose physical rim (15) is not coincident with the boundary of the electrical aperture but whose focal point is known. A transmitting feed horn array (34) consisting of at least two feed horn elements (36, 38) is positioned asymmetrically on either side of an estimated focal axis (40) which is generally inclined with respect to the boresight axis (12) of the antenna. The feed horn array (34) is aligned with the estimated focal axis (40) so that the phase centers ($CP_1$, $CP_2$) of the two feed horn elements (36, 38) are located on a common line (42) running through the focal point (F) orthogonally with respect to the estimated focal axis. RF circuit means (44) are coupled to the feed horn elements for generating RF electric field components which are directed to the offset antenna (14) whereupon sum and difference radiation far field patterns ($\Sigma$, $\Delta$) are generated and transmitted in a manner analogous to systems of the monopulse angle tracking type. The far field radiation patterns ($\Sigma$, $\Delta$) are sensed by a far field detector (43) and the transmitting array (34) is rotated in discrete angular ($\beta$) incremental steps in at least one plane about an axis through the focal point whereupon the amplitude of the minimum value of the difference radiation pattern ($\Delta$) as a function of angular rotation ($\beta$) is detected and measured with a determination being made of the angular orientation of the array where extreme magnitude of the minimum difference pattern signal strength occurs, which location is indicative of the focal axis (26) being determined. Alternatively, the relative phases ($\psi_{93}$, $\psi_{66}$) of the sum and difference radiation patterns ($\Sigma$, $\Delta$) are detected and measured as a function of angular rotation ($\beta$) and their difference value ($|\psi_{93}-\psi_{66}|$) determined. The maximum difference value provides an indication of the location of the focal axis (26) being determined.

27 Claims, 13 Drawing Figures

FIG. 1A
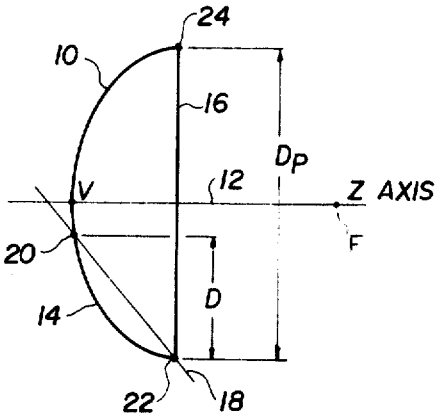
FIG. 1B
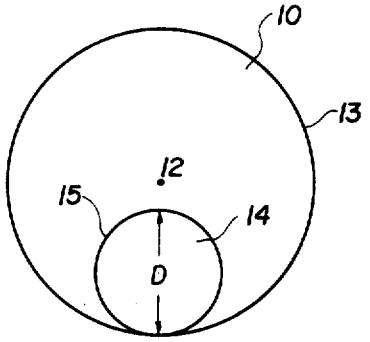
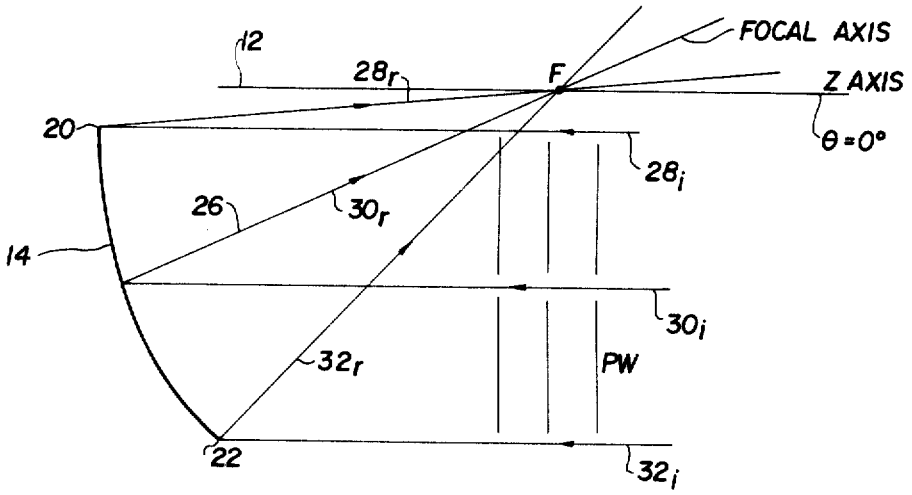
FIG. 2

FIG.4
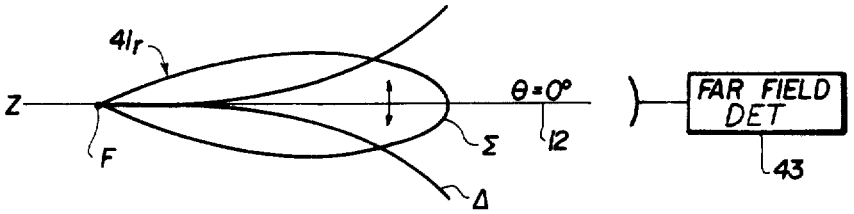
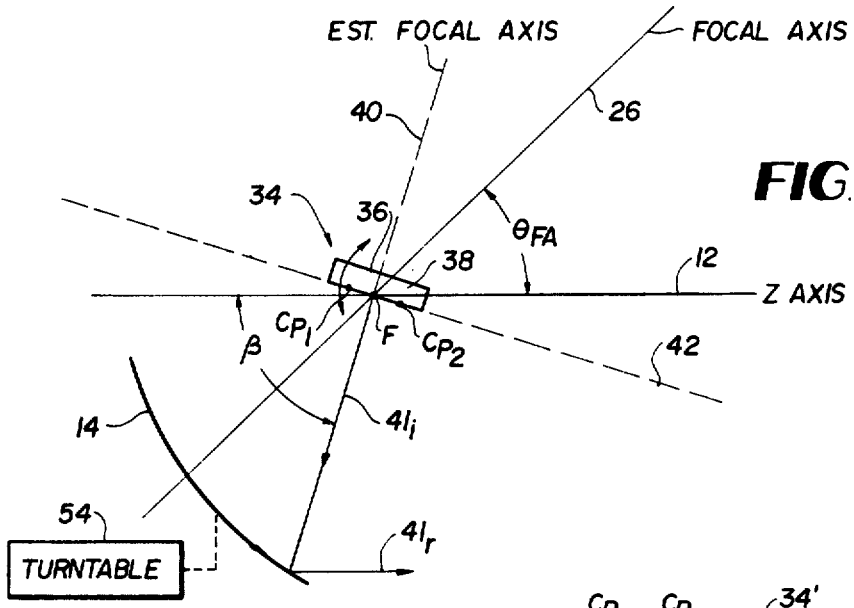
FIG.3
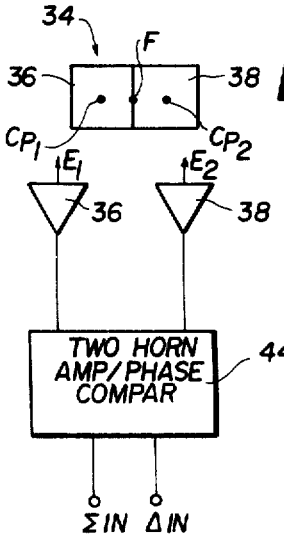
FIG.5
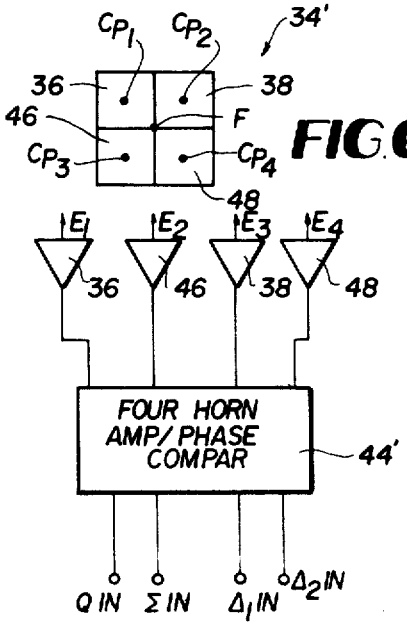
FIG.6
FIG.7
FIG.8

FOCAL AXIS RESOLVER FOR OFFSET REFLECTOR ANTENNAS

ORIGIN OF THE INVENTION

The invention described herein was made by an employee of the U.S. Government and may be manufactured and used by or for the Government for governmental purposes without the payment of any royalties thereon or therefor.

TECHNICAL FIELD

The invention relates generally to focal axis determination of asymmetrical reflector antennas and more particularly to a method and apparatus for determining the focal axis of offset paraboloidal antennas.

BACKGROUND ART

The focal point of reflector antennas of electromagnetic energy is of considerable interest and, in many cases, is sufficient for locating the antenna feed when the focal axis is of no particular concern. However, knowledge of the focal axis is necessary for controlling squint which occurs when the feed is located off the focal axis or for defocusing the feed by movement of the feed back and forth along the focal axis for varying the pattern beamwidth. Both of these concepts are well known and have been used extensively in the prior art.

Focal axis determination has not presented a problem in the past where traditional symmetrical reflectors were utilized because there the focal axis could easily be established by passing a line through the vertex of the antenna perpendicular to the aperture plane defined by the physical rim. Such is not the case, however, for offset antennas currently being used in spacecraft and other ground station type installations due to the fact that the physical rim of the offset antenna is not generally congruent with the aperture plane but is, in fact, elliptical when the aperture plane is circular. Accordingly, a need has arisen for accurately determining the focal axis of an offset reflector which is both simple and can be carried out quickly, thus providing a predictability of the result of feed movement about the focal axis and focal point to control not only squint, but also beamwidth.

STATEMENT OF THE INVENTION

Accordingly, it is an object of the present invention to provide a method and apparatus for locating the focal axis of an asymmetrical reflector antenna.

Another object of the invention is to provide a method and apparatus for locating the focal axis of a truncated reflector antenna.

Still another object of the invention is to provide a method and apparatus for determining the focal axis of an offset reflector antenna.

These and other objects are provided by the utilization of a transmitting feed horn array located at the known focal point of an offset reflector antenna and aligned with an estimated focal axis of the antenna. The array is coupled to an amplitude or phase comparison feed circuit which is adapted to provide sum and difference output fields which are directed to and reflected from the antenna as sum and difference radiation patterns. The feed horn array is rotated in discrete steps in at least one plane about an axis through the focal point of the antenna and at each step the far field radiation is received and detected in amplitude and the minimum value of the difference pattern at each step is noted. The minimum value of the difference signal is sensed, for example, by rotating the antenna under test in a conventional manner in front of a fixed far field detector. The axial alignment of the feed horn array at the position wherein the extreme or lowest value of the minimum difference signal occurs provides an indication of the true focal axis of the antenna. Alternatively, the magnitude of the relative phase difference between the sum and difference patterns is detected with the resulting peak value thereof providing an indication of the true focal axis.

The foregoing as well as other objects, features and advantages of the invention will become apparent from the following detailed description when taken in conjunction with the appended drawings.

BRIEF DESCRIPTION OF THE DRAWINGS

FIGS. 1A and 1B are diagrams illustrative of the typical geometry of an offset paraboloid reflector antenna in relation to a symmetrical parent antenna;

FIG. 2 is a ray diagram illustrative of the location of the focal axis and focal point of an offset paraboloidal reflector;

FIG. 3 is a diagram generally illustrative of the method for determining the focal axis of an offset reflector antenna in accordance with the subject invention;

FIG. 4 is a diagram helpful in understanding the method illustrated in FIG. 3;

FIGS. 5 and 6 are diagrams illustrative of a two feed horn and a four feed horn cluster utilized in practicing the method of the subject invention;

FIG. 7 is a block diagram of a first embodiment of electrical apparatus utilized for exciting the two feed horn cluster as shown in FIG. 5;

FIG. 8 is a block diagram illustrative of a second embodiment of electrical apparatus utilized for exciting the four feedhorn cluster shown in FIG. 6;

DETAILED DESCRIPTION OF THE INVENTION

Figure 9:
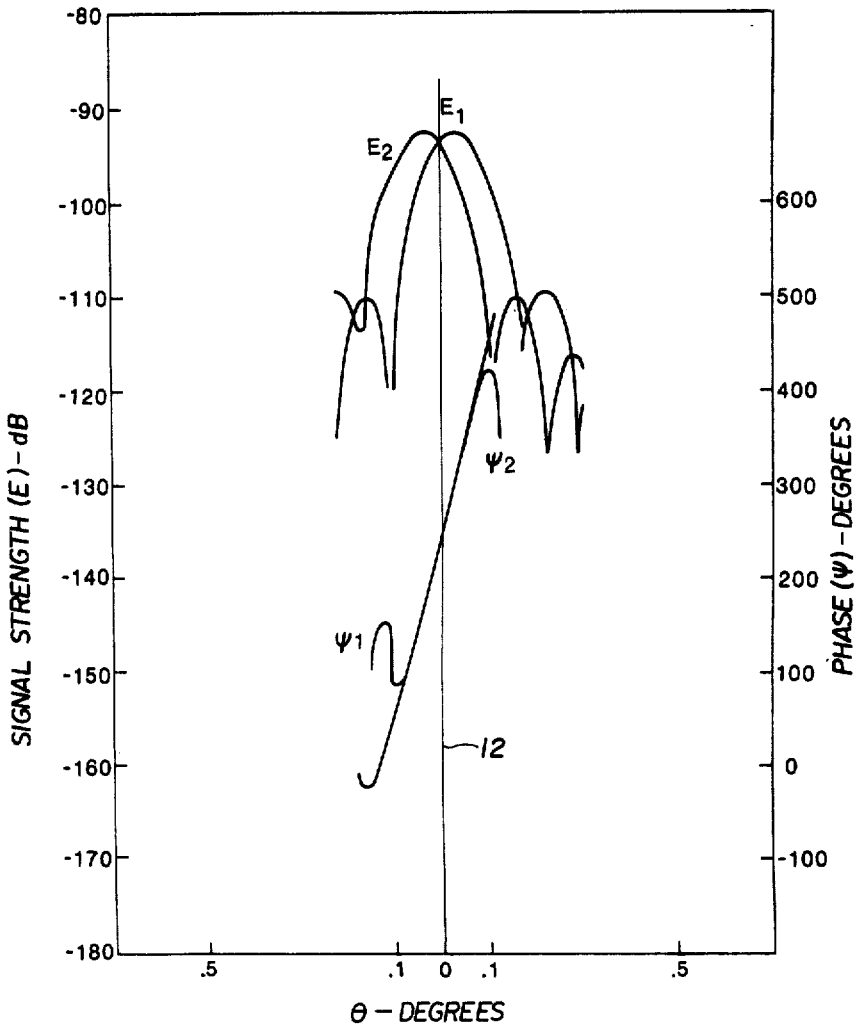
FIG. 9 is a graphical representation of separate radiation pattern components resulting from feed displacements as shown in FIG. 3 for a two horn array.

Referring now to the drawings and more particularly to FIGS. 1A and 1B, reference numeral 10 is illustrative of a parent paraboloid reflector antenna whose physical rim 13 is symmetrical about a central longitudinal Z axis 12 which passes through a focal point F and a vertex V. The axis 12 is commonly referred to as the "boresight" axis of the antenna. An offset paraboloid reflector 14 which comprises a truncated portion of the parent reflector 10, is located below the Z axis 12. Whereas the aperture plane 16 of the parent antenna 10 is coincident with the physical rim of the parent reflector and is transverse to the central Z axis 12, the plane 18 of the physical rim 15 of the offset reflector 14 is inclined with respect to the aperture plane 16 providing thereby a relatively smaller reflector whose rim is generally elliptical in shape. Due to the fact that the offset reflector 14 comprises an angulated slice or a small portion of the parent antenna, if it is made to maintain its position relative to the parent antenna, the focal point F remains common to both. It can be seen from FIG. 1A, however, that whereas the central Z axis 12 of the parent reflector 10 constitutes the focal axis thereof, it does not constitute the focal axis of the offset reflector 14.

Because the physical rim 15 of the offset antenna which is bounded by the points 20 and 22 (FIG. 1A) is not the same as the physical or aperture rim 13 of the parent antenna as defined by points 22 and 24, standing by itself, one is deprived of the knowledge of the focal axis of the offset reflector 14. This situation is intolerable where a control of squint and defocusing is required. As is well known, squint is achieved by the location of the feed on either side of the focal axis in the vicinity of the focal point while defocusing is achieved by axially moving the feed along the focal axis in front of or behind the focal point which movement has the effect of changing the beamwidth of the radiated antenna pattern.

In order to illustrate the position of the focal axis of the offset antenna 14, it can be done by invoking the principle of reciprocity, meaning that all rays parallel to its boresight axis and incident to the antenna will be reflected through the focal point and vice versa. Referring now to the ray diagram of FIG. 2, the true focal axis 26 of the offset reflector 14 is shown passing through the focal point F which lies along the boresight axis 12, the focal axis of the parent antenna 10, but is angularly inclined thereto and substantially coincident with a central reflected ray $\mathbf{30}_r$ which passes through the focal point following the incidence of an input planar wave PW which emanates from a far field source, not shown, situated on the boresight axis. The planar wave includes the incident rays $\mathbf{28}_i$, $\mathbf{30}_i$ and $\mathbf{32}_i$ from which the reflected rays $\mathbf{28}_r$, $\mathbf{30}_r$ and $\mathbf{32}_r$ result, all passing through the focal point F.

In the subject invention it is assumed that the focal point F is known, having been determined by any known method such as sensing radiation pattern minima by trial and error. Having determined the location of the focal point F, the present invention resolves the focal axis of an offset truncated paraboloidal antenna such as the one designated by the reference numeral 14 by an iterative method involving the initial assumption of an inclined candidate or estimated focal axis and thereafter detecting the far field radiation reflected from the offset antenna under test following selective rotation of a transmitting feed horn array located at the focal point.

More particularly, and with reference to FIG. 3, a transmitting feed horn array 34 consisting of at least two feed horns 36 and 38, typically having a half wavelength ($\lambda/2$) aperture diameter, are arranged side by side at the focal point F so that they are axially aligned with but are disposed equidistantly on either side of the arbitrarily chosen estimated focal axis 40. Moreover, the phase centers $CP_1$ and $CP_2$ of the two feed horns 36 and 38 lie along a common line or plane 42 which passes through the focal point F and is orthogonal to the estimated focal axis 40.

The purpose of the feed horn array 34 is to excite the offset antenna 14 with incident RF energy $\mathbf{41}_i$ where it is reflected therefrom as energy $\mathbf{41}_r$ which is in the form of sum and difference radiation patterns $\Sigma$ and $\Delta$ which are shown in FIG. 4 as being symmertical about the Z or boresight ($\theta=0°$) axis 12 and where the patterns are furthermore directed to and sensed by a far field detector 43 utilized for making conventional antenna radiation pattern measurements. The sum and difference radiation patterns $\Sigma$ and $\Delta$ are generated in a manner analogous to well known monopulse techniques by utilizing a conventional monopulse two horn amplitude or phase comparator 44 as shown in FIG. 7 having quadrature sum and difference input ports $\Sigma_{in}$ and $\Delta_{in}$ for receiving RF energy to be transmitted from an RF generator, not shown. Feed horns 36 and 38, being coupled to the comparator 44, operate in accordance with the principles of monopulse operation to produce sum and difference RF energy field components which are directed to the offset antenna 14 and are reflected therefrom as sum and difference patterns as shown in FIG. 4. The principles of monopulse are set forth in detail, for example, in a textbook entitled, *Introduction To Monopulse*, by D. R. Rhodes, McGraw-Hill, 1959, and can be referred to for a more comprehensive treatment of the subject. While both sum and difference radiation patterns are produced, it is the difference pattern which is of primary concern with respect to the preferred method and apparatus of the invention.

While at least two feed horns are required, an array or cluster 34' of four feed horns can be utilized as an alternative embodiment. Such a configuration is shown in FIG. 6 where, for example, two additional feed horns 46 and 48 are arranged beneath the aforementioned feed horns 36 and 38 utilized in the array 34 (FIG. 5). However, the focal point F is located at the phase center of the cluster intermediate the phase centers $CP_1$, $CP_2$, $CP_3$ and $CP_4$. In such a configuration, the feed horns 36 and 46 are located on one side of the estimated focal axis 40 while the feed horns 38 and 48 are located on the other side of the estimated focal axis 40. In order to couple sum and difference RF field components to the feed horns, a four horn monopulse comparator circuit 44' is utilized. Such a circuit is well known and typically includes four inputs $Q_{in}$, $\Sigma_{in}$, $\Delta_{1in}$ and $\Delta_{2in}$ which are suitably coupled to an RF source, not shown, in order to feed the four feed horns 36, 38, 46 and 48.

Referring now back to FIG 3, the heart of the invention lies in incrementally rotating the feed horn array 34 either by hand or by conventional means, not shown, in at least one plane passing through the focal point F about an angle $\beta$ with respect to the Z or boresight axis and while exciting the antenna 14 noting the variation of the sum and difference patterns as a function of the stepped rotation of the feed horn array. This is done in a conventional manner, for example, by utilizing a fixed far field detector 43 (FIG. 4) which is sensitive to amplitude and/or phase of the received radiation and rotating the antenna 14 by means of a turntable 54 so that the boresight axis 12 swings past the input aperture of the detector. More particularly, the difference radiation pattern $\Delta$ will exhibit a minimum value which changes as the angle $\beta$ varies and accordingly the smallest or extreme minimum value will occur when the angle $\beta$ is equal to the angle $\theta_{FA}$. At that angular position of the feed horn array 34, it will be aligned with the true focal axis 26. This phenomenon not only exists for signal amplitude measurements made by the fixed far field detector 43 as the turntable 54 rotates the offset antenna 14 in order to make the required antenna measurements. but it also pertains to the phase difference of the antenna patterns. By making the detector 43 sensitive to phase. a discontinuous phase jump will be detected at $\theta=0°$ as the boresight axis 12 swings past the fixed position detector 14 when the feedhorn array 34 is positioned at an angle $\beta=\theta_{FA}$.

This phenomenon can be understood better when considered in light of the graphs shown in FIGS. 9 through 12. FIG. 9 illustrates two sets of graphs, one for the beam amplitudes $E_1$ and $E_2$, and the other for the phases $\psi_1$ and $\psi_2$ of the two field components emanating from the two feed horns 36 and 38 shown in FIG. 5. The graphs $E_1$ and $E_2$ show the field distribution or the transmitted radiation patterns due to the feed horns 36 and 38 being located on either side of the estimated focal axis 40 as shown in FIG. 3. The fact that the two main lobes of the plots $E_2$ and $E_1$ are offset from one another depicts the separation of the phase centers $CP_1$ and $CP_2$ on opposite sides of the estimated focal axis 40. The graphs of the phases $\psi_1$ and $\psi_2$ on the other hand reflect a sharp transition around the bore sight axis 12 and are 180° with respect to one another.

Figure 10:
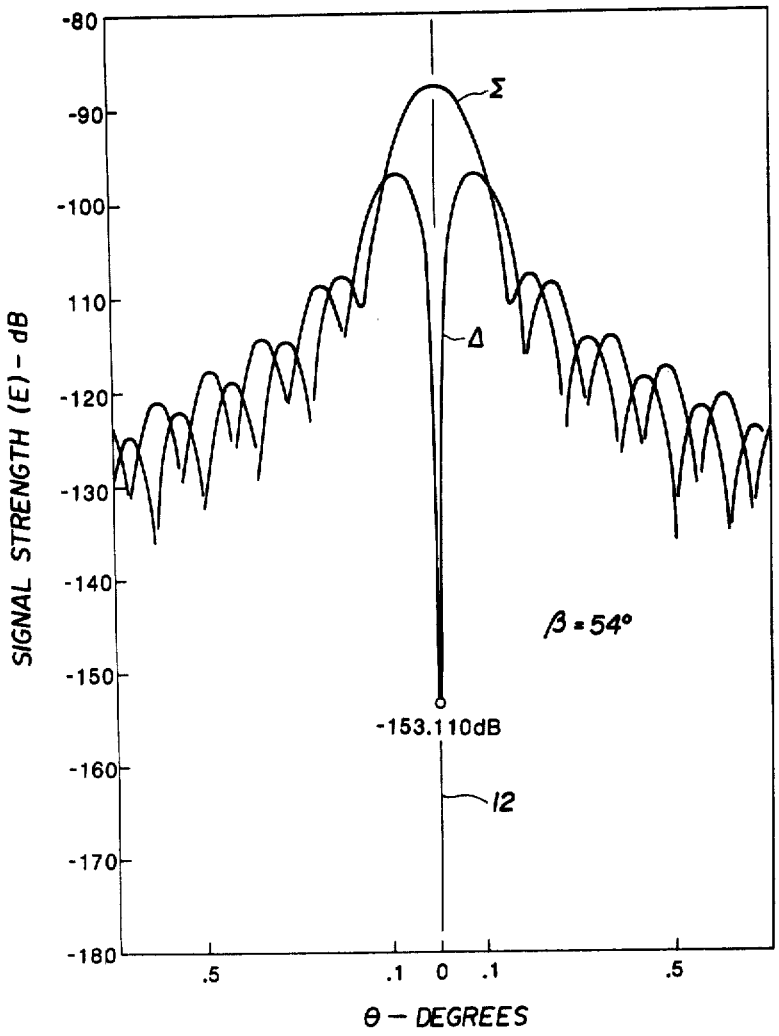
FIG. 10 is a graphical illustration of power distribution of both sum and difference signal patterns provided by the electrical apparatus shown in FIGS. 7 and 8.
Figure 11:
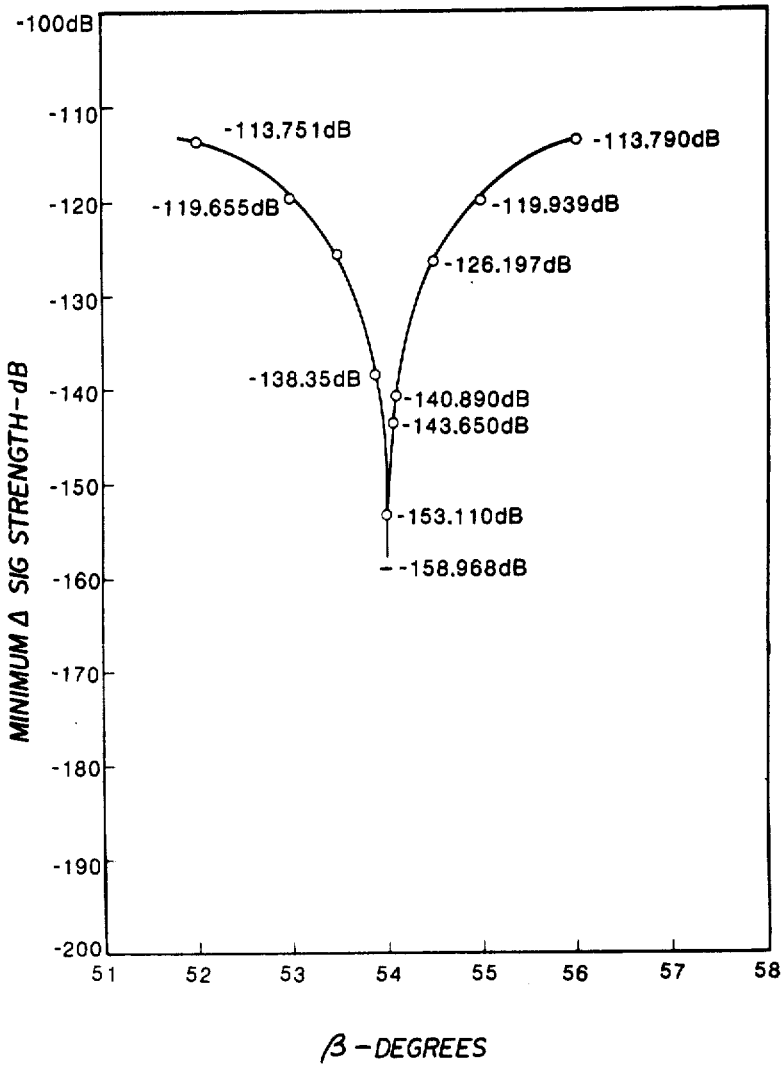
FIG. 11 is a graphical illustration of a plot of the magnitude of the minimum difference signal for various rotational angles of the transmitting feed horn array in accordance with the method of the invention.

While FIG. 9 is illustrative of the electrical field distribution transmitted by two separate feed horns, FIG. 10 is illustrative of the sum and difference radiation patterns $\Sigma$ and $\Delta$ which result from a spatial combination of the electric fields $E_1$ and $E_2$ transmitted by the two feed horns 36 and 38 when the estimated focal axis consists of an angle $\beta=54°$. The sum pattern $\Sigma$ is shown having a rounded main lobe centered at the system boresight axis 12 where $\theta=0°$. While the difference pattern $\Delta$ exhibits a relatively sharp minimum value or dip at $\theta=0°$, the invention relies on the fact that the magnitude of the minimum value of the difference signal is not constant but varies as a function of the angle of rotation $\beta$ of the feed assembly 34 about the focal point F. Such a variation is shown by the graph of FIG. 11 wherein measurements of the minimum values of the signal strength of the difference patterns $\Delta$ for discrete steps of angular position of $\beta$ as the feed horn assembly 34 is rotated in increments over the range of 52° to 56°. The graph of FIG. 11 illustrates that the minimum value of the signal strength of the $\Delta$ pattern decreases very rapidly to a well defined extreme value in the region of $\beta=54°$ during the process of making amplitude measurements of the radiation patterns by means of the detector 43 when the truncated antenna 14 is rotated, for example, by means of the turntable 54.

Figure 12:
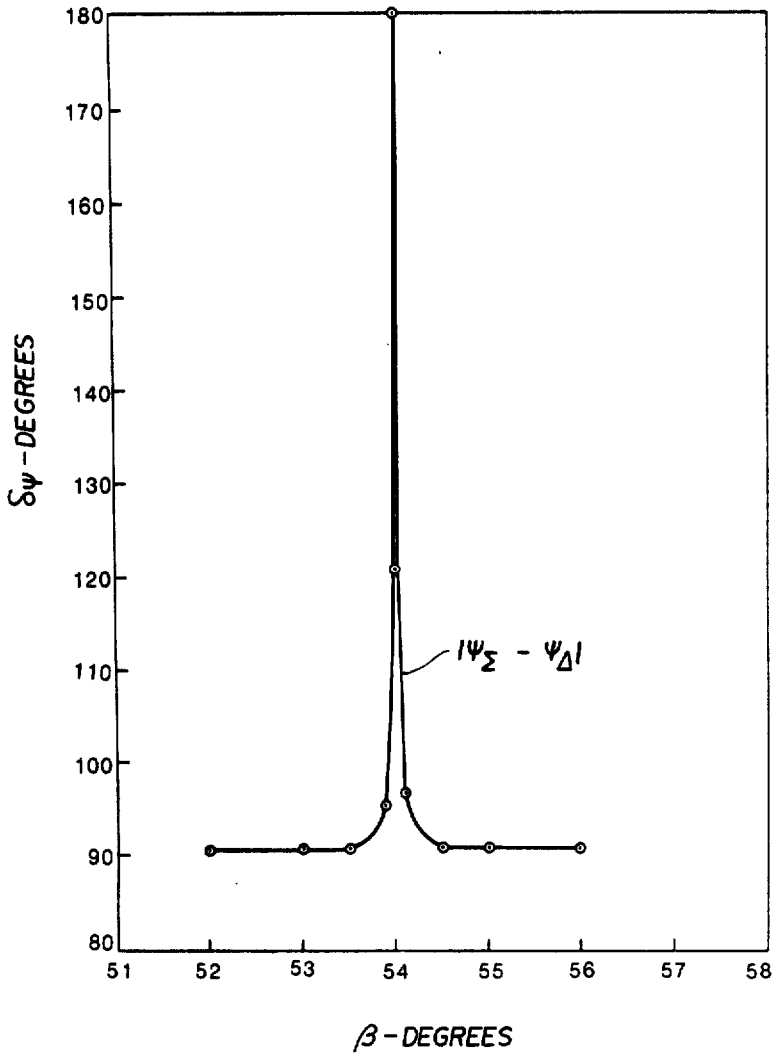
FIG. 12 is a graphical illustration of the variation of relative phase difference for the sum and difference radiation patterns for a rotation of the transmitting feed horn array in accordance with the method of the invention.

Where, for example, the far field detector 43 is of the type which is sensitive to and is thus adapted to measure phase $\psi$, as opposed to amplitude, a plot of the absolute value $|\psi_\Sigma-\psi_\Delta|$ of relative phase difference between the phases $\psi_\Sigma$ and $\psi_\Delta$ of the sum and difference patterns $\Sigma$ and $\Delta$ as shown by FIG. 12 for discrete angular positions of the feed horn array 34 between the angles $\beta=52°$ and 56° exhibits a sharp peak value at $\beta=54°$ thereby providing an alternative indication of the location of the true focal axis 26 of the offset antenna 14.

Accordingly, the focal axis of an offset reflector antenna as evidenced by the foregoing explanation can be obtained by placing a feed horn assembly capable of exciting sum and difference radiation patterns from the offset antenna at the antenna's known focal point and thereafter rotating the feed horn assembly in successive steps in the plane about an axis through the focal point of the antenna following the selection of an estimated focal axis and then observing the magnitude of the difference pattern or the relative phase difference between the sum and difference patterns transmitted from the antenna and measured by a far field detector. By observing the angular position of the feed horn assembly and a corresponding minimum value of the difference signal measured at each angular position, the lowest or extreme value of the minimum value of the difference signal provides an indication of the angle ($\beta=\theta_{FA}$) of the true focal axis of the offset antenna as illustrated in FIG. 11. Similarly, by noting the peak value of the difference between the relative phase difference between the sum and difference patterns as shown in FIG. 12, this also establishes the location of the true focal axis of the offset antenna.

While the foregoing description has been made from the standpoint of the utilization of an active transmitting feed horn assembly being located at the focal point of the offset antenna under test and thereafter measuring the far field radiation pattern resulting from irradiating the antenna under test at various angular positions of the feed horn assembly relative to the boresight axis, the principle of reciprocity suggests that when desirable, the operation of the transmitting feed horn assembly 34 and the far field detector 43 can be reversed, i.e. the feed horn assembly 34 as shown in FIG. 3 is utilized as part of a detector assembly and thereafter irradiating the antenna from a far field source similar to the diagram shown in FIG. 2 but with the far field source transmitting a plane wave.

While the foregoing detailed description has been shown and described with respect to resolving the true focal axis in one plane, it should be noted that the same procedure can be carried out in a second or orthogonal plane to resolve the focal axis. Thus the method of this invention is able to resolve the focal axis for offset geometries where no aperture plane, per se, can be identified by utilizing a technique similar to monopulse. With the true focal axis of the offset paraboloidal reflector determined, one is able to then utilize the antenna not only in a controlled squint mode, but is particularly useful in applications where defocusing is employed to maintain a constant beamwidth where multiple or variable frequency feeds are associated therewith. This is particularly true for radiometric applications in spacecraft where beam spot size must be tightly controlled for multiple frequencies while avoiding squint.

Having thus shown and described what is at present considered to be the preferred method and apparatus for determining the true focal axis of an offset antenna, the foregoing has been made by way of illustration and not limitation and accordingly all modifications, alterations and changes coming within the spirit and scope of the invention are herein meant to be included.

I claim:

1. The method of determining the focal axis (26) of an offset reflector paraboloidal antenna (14), whose focal point (F) is known, comprising the steps of:

estimating a focal axis (40) running from the surface of said antenna through said focal point (F);

positioning means (34) for generating a plurality of electric field components at said focal point (F) and aligning said means with the estimated focal axis (40);

directing said electric field components to said antenna along said estimated focal axis whereupon far field sum and difference radiation patterns ($\Sigma$, $\Delta$) are provided by said offset antenna (14);

rotating said generating means (34) about an axis (40) through the focal point (F) in a common place;

detecting the far field radiation patterns ($\Sigma$, $\Delta$);

measuring a characteristic of the far field radiation patterns ($\Sigma$, $\Delta$) which varies as a function of rotation ($\beta$) of said generating means; and determining an extreme magnitude of said characteristic, which magnitude indicates a particular position ($\beta=\theta_{FA}$) of rotation of said means (34) for generating sum and difference fields and which position corresponds to the focal axis (26) being determined.

2. The method as defined by claim 1 wherein under the principle of reciprocity a reversal of the generating and detecting steps is effected.

3. The method as defined by claim 1 wherein said steps of positioning comprises locating at least two RF field transmitting feed means (36, 38) side by side on either side of the estimated focal axis (40).

4. The method as defined by claim 1 wherein said estimating step comprises selecting a candidate focal axis (40) generally inclined with respect to the central or boresight axis (12) of said antenna (14).

5. The method as defined by claim 1 wherein said rotating step comprises angularly rotating said generating means (34) in angular increments ($\beta$).

6. The method as defined by claim 5 and wherein said measuring step comprises measuring a characteristic ($\Delta_{min}$, $\delta_{\psi}$) of the far field radiation patterns ($\Sigma$, $\Delta$) at each angular increment ($\beta$).

7. A method as defined by claim 1 wherein said step of positioning comprises positioning a pair of RF transmitting feed horns (36, 38) on a common line running (42) through said focal point (F) orthogonally with respect to the estimated focal axis (40).

8. The method as defined by claim 1 wherein said step of measuring the characteristic of the far field radiation patterns ($\Sigma$, $\Delta$) comprises measuring the field strength of the difference radiation pattern ($\Delta$) and determining the minimum value ($\Delta_{min}$) thereof, and wherein said determining step comprises determining the extreme magnitude of said minimum value ($\Delta_{min}$).

9. The method as defined by claim 8 and wherein said step of rotating said generating means comprises rotating a feed horn array (34) in predetermined incremental angular steps ($\beta$), and wherein said step of measuring comprises measuring the minimum value ($\Delta_{min}$) of the field strength of the difference pattern ($\Delta$) at a plurality of said angular steps ($\beta$).

10. The method as defined by claim 9 wherein said measuring step comprises measuring said field strength at each of said angular steps ($\beta$) and said determining step comprises providing a visual representation of the magnitude of the minimum field strength ($\Delta_{min}$) of the difference pattern ($\Delta$) at said plurality of steps ($\beta$) and determining therefrom the extreme value of said minimum signal strength ($\Delta_{min}$), which extreme value occurs at $\beta=\theta_{FA}$ and corresponds to the focal axis (26) being determined.

11. The method as defined by claim 10 wherein said step of providing a visual representation comprises plotting or graphing said magnitude of the minimum field strength ($\Delta_{min}$).

12. The method as defined by claim 1 wherein said step of measuring a characteristic of the far field radiation patterns comprises determining the relative phase ($\psi_\Sigma$, $\psi_\Delta$) of the respective sum and difference radiation patterns ($\Sigma$ and $\Delta$).

13. The method as defined by claim 12 wherein said determining step comprises determining the absolute value ($|\psi_\Sigma-\psi_\Delta|$) of the difference between the relative phases ($\psi_\Sigma$, $\psi_\Delta$) of the sum and difference patterns ($\Sigma$ and $\Delta$) and noting the maximum value ($|\psi_\Sigma-\psi_\Delta|_{max}$) thereof providing an indication of the location of the focal axis (26) being determined.

14. The method as defined by claim 13 wherein said step of determining additionally comprises providing a visual representation of the absolute value ($|\psi_\Sigma-\psi_\Delta|$) of the difference between the relative phases ($\psi_\Sigma$, $\psi_\Delta$) of the sum and difference patterns ($\Sigma$, $\Delta$) at each angular increment ($\beta$).

15. The method as defined by claim 3 wherein said step of positioning includes positioning at least two additional RF field transmitting feed means (46, 48) adjacent said at least two transmitting feed means (36, 38) and being respectively located on opposite sides of the estimated focal axis (40).

16. Apparatus for determining the focal axis (26) of an offset antenna (14), whose focal point (F) is known, comprising in combination:

means (34) for generating at least one far field radiation pattern located at said focal point and aligned with an estimated focal axis (40) running from the surface of said offset antenna (14) through said focal point (F);

means for rotating said generating means (34) about an axis through the focal point in a common plane;

means (43) for detecting said at least one far field radiation pattern located apart from said offset antenna (14), or conversely under the principle of reciprocity a reversal of the location of said means (34) for generating and said means (43) for detecting is provided;

means (43) for measuring a characteristic of the detected far field radiation pattern which varies as a function of rotation of said generating or sensing means; and means (43) for determining an extreme magnitude of said characteristic, which magnitude indicates a particular position ($\beta=\theta_{FA}$) of rotation of said generating means (34), which position corresponds to the focal axis (26) being determined.

17. Apparatus for determining the focal axis (26) of an offset antenna (14) whose focal point (F) is known, comprising in combination:

RF feed circuit means including at least two radiators (36, 38) respectively positioned on each side of an estimated focal axis (40) of said offset antenna (14) at the location of said focal point (F), and being operable to generate at least two electric field components which radiate from said antenna as sum and difference far field radiation patterns ($\Sigma$, $\Delta$), said radiators (36, 38) being in axial alignment with the estimated focal axis (40) and having respective phase centers ($CP_1$, $CP_2$) located on a common line (42) running through said focal point (F) orthogonally with respect to the estimated focal axis (40);

means for angularly ($\beta$) rotating said at least two radiators (36, 38) in a plane including said estimated focal axis and having a center of rotation at said focal point (F);

far field radiation pattern detection means (43) located externally of said offset antenna (14) and including means for measuring a characteristic of said far field radiation patterns ($\Sigma$, $\Delta$) which varies as a function of angular rotation ($\beta$) of said two radiators; and means (43) for determining an extreme magnitude of said characteristic which magnitude indicates a particular angular position ($\beta=\theta_{FA}$) of rotation of said at least two radiators (36, 38) which position corresponds to the focal axis (26) being determined.

18. The apparatus as defined by claim 17 wherein said radiators (36, 38) comprise at least two RF feed horns.

19. The apparatus as defined by claim 18 wherein said feed horns (36, 38) are comprised of elements having a half wavelength aperture diameter.

20. The apparatus as defined by claim 17 wherein said RF feed circuit means (34) includes at least two feed horn elements (36, 46 and 38, 48) located on each side of the estimated focal axis (40) in a four horn cluster centered at said focal point.

21. The apparatus as defined by claim 17 wherein said feed circuit means (34) additionally includes monopulse type signal comparator means (44) having sum and difference inputs ($\Sigma_{in}$, $\Delta_{in}$) which are adapted to be coupled to a source of RF energy and operative to provide said two electric field components which produce said sum and difference radiation patterns ($\Sigma$, $\Delta$) when reflected from said offset antenna (14).

22. The apparatus as defined by claim 17 wherein said means for measuring (43) a characteristic of the far field radiation pattern comprises means for measuring the amplitude of the difference far field radiation pattern ($\Delta$).

23. The apparatus as defined by claim 21 wherein said means for measuring the amplitude of the difference radiation pattern comprises means for measuring the minimum value ($\Delta_{min}$) of the difference pattern signal strength for a plurality of angular positions ($\beta$) of rotation of said radiators (36, 38).

24. The apparatus as defined by claim 17 wherein said means for rotating said at least two radiators comprises means for rotating said radiators in predetermined incremental angular steps ($\beta$) and wherein said means for measuring (43) comprises means for measuring the minimum amplitude of the difference pattern ($\Delta_{min}$) signal strength at each step.

25. The apparatus as defined by claim 17 wherein said means (43) for measuring the characteristic comprises means for sensing the relative phase ($\psi_\Sigma$, $\psi_\Delta$) of the far field sum and difference radiation patterns ($\Sigma$, $\Delta$).

26. The apparatus as defined by claim 24 and wherein said means (43) for determining an extreme magnitude of said characteristic comprises means for determining the peak value of the difference ($|\psi_\Sigma-\psi_\Delta|$) of the relative phases ($\psi_\Sigma$, $\psi_\Delta$) of the sum and difference radiation patterns ($\Sigma$, $\Delta$).

27. The apparatus as defined by claim 17 wherein said means for rotating said at least two radiators comprises means for rotating said radiators as a unit in two separate planes, which planes include said estimated focal axis (40) and include said focal point (F) as a rotational axis.

* * * * *